US011001984B2

(12) United States Patent
Pratt et al.

(10) Patent No.: US 11,001,984 B2
(45) Date of Patent: May 11, 2021

(54) DUMP BUCKET WITH INSERT FOR SIDE DUMPING

(71) Applicant: Rockland Manufacturing Company, Bedford, PA (US)

(72) Inventors: William Kendall Pratt, Bedford, PA (US); Travis James Wirfel, Windber, PA (US)

(73) Assignee: Rockland Manufacturing Company, Bedford, PA (US)

( * ) Notice: Subject to any disclaimer, the term of this patent is extended or adjusted under 35 U.S.C. 154(b) by 0 days.

(21) Appl. No.: 16/040,089

(22) Filed: Jul. 19, 2018

(65) Prior Publication Data

US 2019/0136485 A1 May 9, 2019

Related U.S. Application Data

(60) Provisional application No. 62/534,644, filed on Jul. 19, 2017.

(51) Int. Cl.
*E02F 3/40* (2006.01)
*E02F 3/407* (2006.01)
*E02F 3/345* (2006.01)

(52) U.S. Cl.
CPC ..... *E02F 3/407* (2013.01); *E02F 3/345* (2013.01); *E02F 3/40* (2013.01)

(58) Field of Classification Search
CPC ..... E02F 3/407; E02F 3/40; E02F 3/45; E02F 3/3417; E02F 3/345; E02F 3/4075
See application file for complete search history.

(56) References Cited

U.S. PATENT DOCUMENTS 2,669,042 A * 2/1954 Swank ..... E02F 3/60 37/398
2,723,471 A * 11/1955 Trundle ..... E02F 3/60 37/398
3,312,364 A * 4/1967 Granryd ..... E02F 3/345 414/705
3,398,472 A * 8/1968 Wilhelm ..... E02F 3/345 37/444
3,407,952 A * 10/1968 Gardner ..... E02F 3/407 414/704
3,475,838 A * 11/1969 Hagen ..... E01H 5/02 37/265
3,659,730 A * 5/1972 Butler ..... E02F 3/407 37/444
3,738,513 A * 6/1973 Wagner ..... E02F 3/407 414/725
3,750,816 A * 8/1973 Becker ..... E02F 3/401 414/704
4,782,606 A * 11/1988 Surface ..... E02F 3/345 37/142.5
5,129,169 A * 7/1992 Aubichon ..... E01H 5/06 172/817

(Continued)

*Primary Examiner* — Jamie L McGowan
(74) *Attorney, Agent, or Firm* — Paul D Bangor, Jr., Esquire; Clark Hill, PLC

(57) ABSTRACT

A dump bucket, comprising a first side, a second side defining a plurality of slots, and an inner surface; and an insert installed between the inner surface and the second side at an angle to aid in side dumping out of the second side of the bucket; wherein tabs defined by the insert are received in the slots in the second side of the bucket.

3 Claims, 8 Drawing Sheets

(56) References Cited

U.S. PATENT DOCUMENTS

| | | | | |
|---|---|---|---|---|
| 5,603,382 | A * | 2/1997 | McIver | A01D 87/0061 172/445.1 |
| 6,167,642 | B1 * | 1/2001 | Nardini | E02F 3/40 37/403 |
| 6,834,447 | B1 * | 12/2004 | Currey | E02F 7/06 37/142.5 |
| 7,484,321 | B1 * | 2/2009 | Stafne, Sr. | E02F 3/401 37/227 |
| 7,832,128 | B2 * | 11/2010 | Doucette | E02F 3/30 37/379 |
| 9,015,970 | B1 * | 4/2015 | Doucette | E02F 3/404 37/444 |
| 2001/0037588 | A1 * | 11/2001 | Royer | E02F 3/7613 37/403 |
| 2005/0178030 | A1 * | 8/2005 | Doucette | E02F 3/3681 37/443 |

* cited by examiner

DUMP BUCKET WITH INSERT FOR SIDE DUMPING

RELATED APPLICATIONS

This application claims the benefit of provisional patent application U.S. Ser. No. 62/534,644 filed Jul. 19, 2017, which is incorporated by reference herein for all purposes.

TECHNICAL FIELD

The present disclosure relates generally to the ability to side dump a bucket connected to a work machine and more particularly to a dump bucket with a removable insert that converts a standard bucket to a side dump bucket.

BACKGROUND

Field of the Disclosure

Present work machines, such as front end loaders and skid steer loaders and the like, utilize various attachments, such as buckets. During certain operations, it is advantageous to have a bucket that has side dump capabilities so that materials within the bucket may be conveniently unloaded at one side of the work machine.

Conventional side dump capability is accomplished using of a separate side dump bucket. One or more cylinders are typically attached in a predetermined manner to the side dump bucket in order to facilitate the side dump capability. During operation, the side dump bucket is raised and the cylinders are actuated to angle the bucket laterally. The side dump bucket is unloaded in a well-known manner by rotating the bucket a sufficient amount, via the dump cycle of the work machine, causing the load to slide out of the bucket by gravity. This side dump actuating structure may be connected directly to the bucket or be a part of the work machine. In either case, in order to achieve the side dump capability, a side dump bucket must be available on a work site. This may require the purchase of both standard buckets and side dump buckets of varying sizes in order to fulfill all the work site requirements. Further, the use of the various buckets may necessitate continuous decoupling and coupling of the various attachments dependent on the bucket desired. Further, because side dump buckets typically dump to only one side of the work machine, it may be necessary to purchase separate side dump buckets that allow dumping to both sides of the work machine. For these and other reasons, the ability to convert a standard bucket to a side dump bucket simply and conveniently would be preferable and useful on the work site to increase operator efficiency and reduce time, energy and costs.

The present disclosure is directed to overcoming the problems as set forth above.

BRIEF SUMMARY OF THE DISCLOSURE

In a preferred aspect, the present disclosure comprises a dump bucket, comprising a first side, a second side defining a plurality of slots, and an inner surface; and an insert installed between the inner surface and the second side at an angle to aid in side dumping out of the second side of the bucket; wherein tabs defined by the insert are received in the slots in second side of the bucket.

In another preferred aspect, the dump bucket of the present disclosure further comprises an insert mount defining first holes disposed on the inner surface and a mounting plate defining second holes disposed on the insert for securely attaching the insert within the bucket utilizing attachment devices disposed through the first and second holes, respectively.

In another aspect of the dump bucket of the present disclosure, a top surface of the insert defines one or more ribs.

In another preferred aspect, the present disclosure comprises a side dumping insert for installation within a dump bucket to facilitate dumping material out of a side of dump bucket comprising a first curved side; a second straight side defining a plurality of tabs wherein the tabs are received in slots in the side of the bucket.

In yet another preferred aspect, the side dumping insert of the present disclosure further comprises a mounting plate defining mounting holes disposed on the insert near the first curved side.

In another aspect of the side dumping insert of the present disclosure, a top surface of the insert defines one or more ribs.

Many other variations are possible with the present disclosure, and those and other teachings, variations, and advantages of the present disclosure will become apparent from the description and figures of the disclosure.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION

In the following detailed description, reference is made to the accompanying examples and figures that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "disclosure" merely for convenience and without intending to voluntarily limit the scope of this application to any single disclosure or inventive concept if more than one is in fact disclosed.

The following description is, therefore, not to be taken in a limited sense, and the scope of this disclosure is defined by the appended claims.

Figure 1:
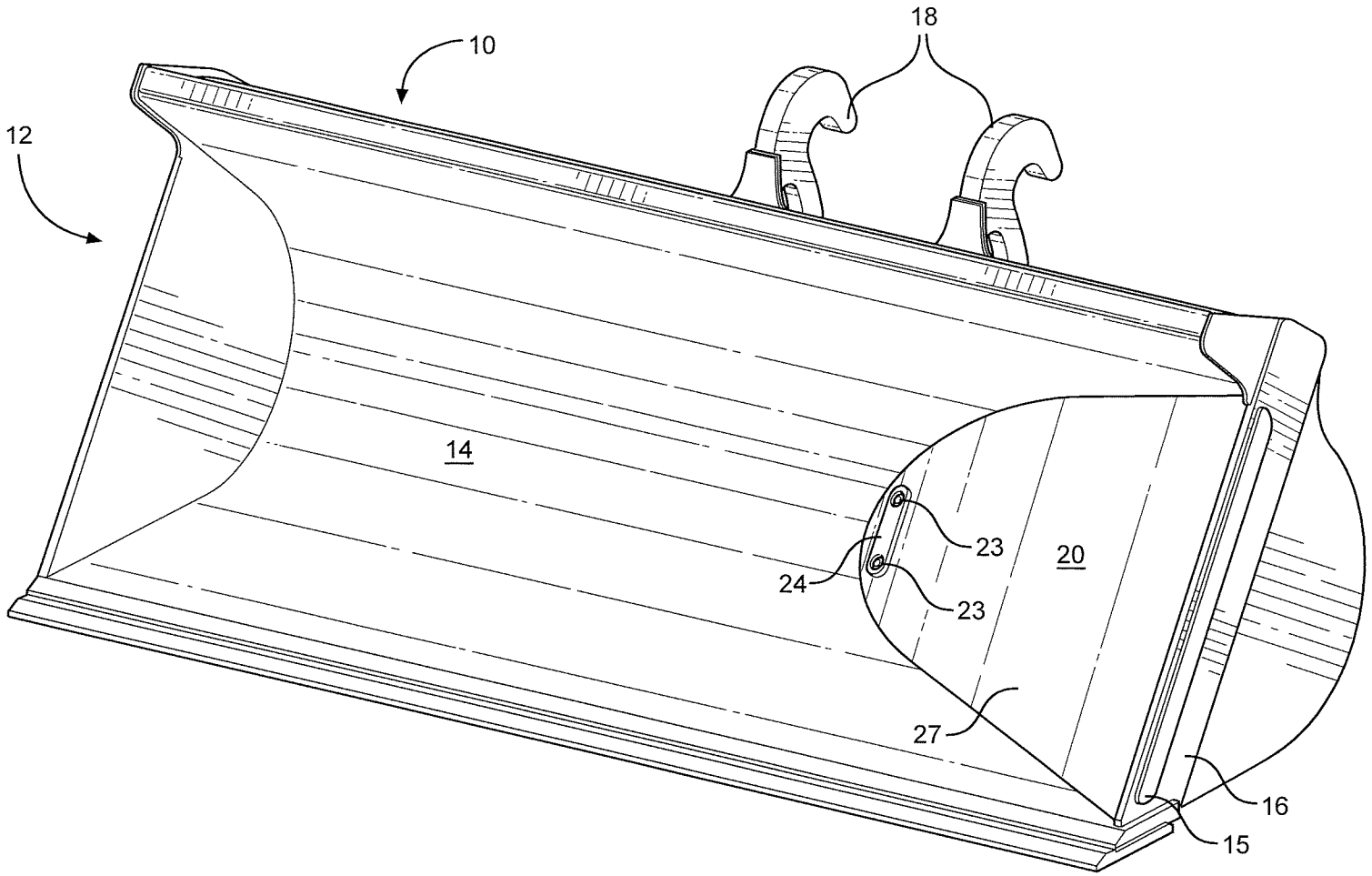
FIG. 1 is a right perspective view of a preferred dump bucket with a removable insert providing side dump capabilities according to the present disclosure.
Figure 7:
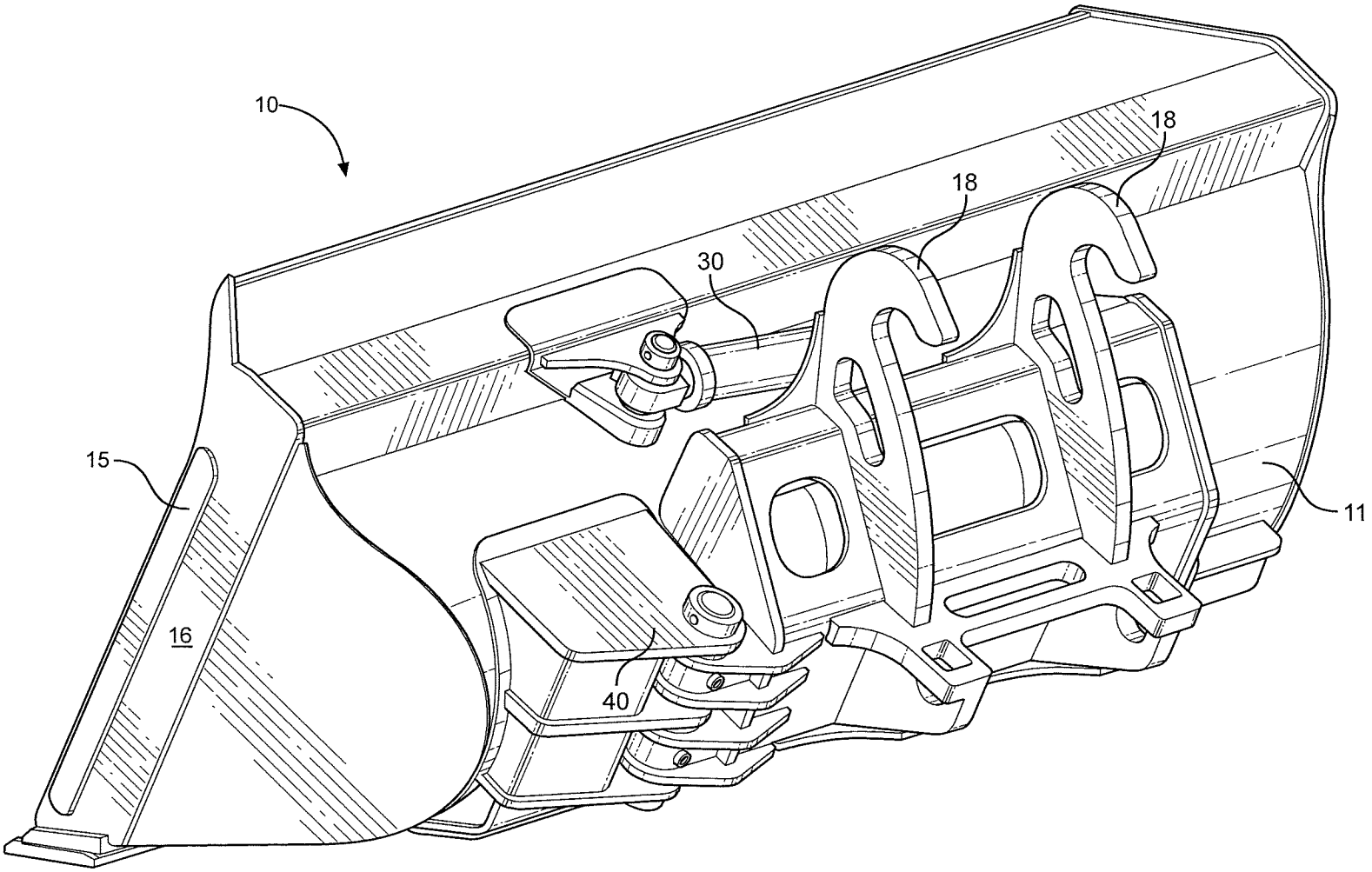
FIG. 7 is a rear perspective view of the dump bucket of FIG. 1.
Figure 8:
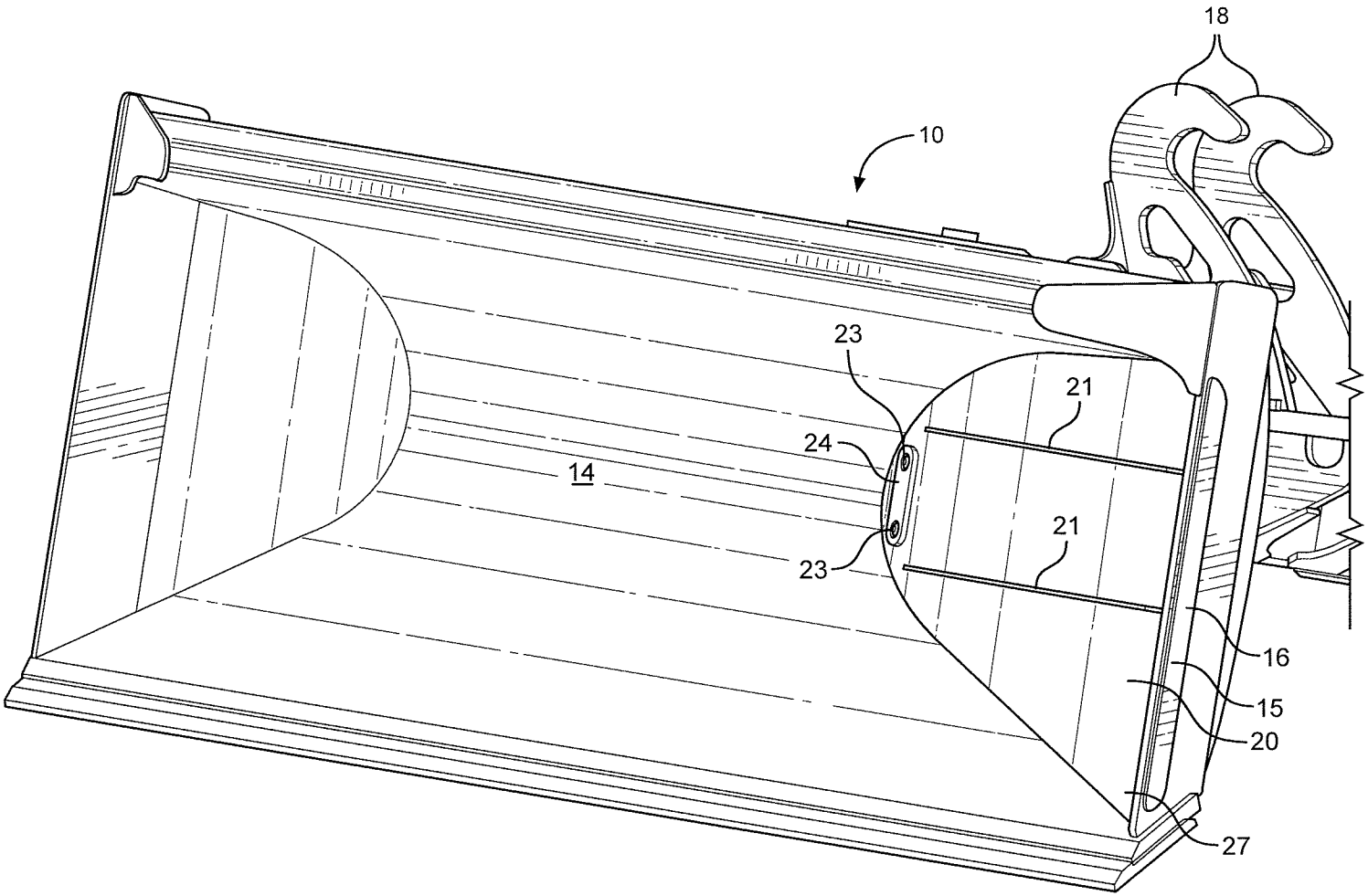
FIG. 8 is a right perspective view of the dump bucket of FIG. 1.

As shown in FIGS. 1-9, a preferred dump bucket 10 of the present disclosure comprises a first side 12, an inner face 14, a second side 16, a back side 11 and hooks 18 or other means for attaching to a dozer or loader (not shown). In addition, an insert mount 19 is preferably disposed on inner face 14 for securely attaching insert 20 within bucket 10 utilizing screws or bolts 25 disposed through holes 23 and 13, respectively. In addition, slots 17 in side 16 receive tabs 22 defined by a side of insert 20 for securing insert within bucket 10. Preferably a cover plate 15 covers the tabs 22 in slots 17 on the outside of side 16 as shown in FIGS. 1 and 7-8. Top surface 27 of insert 20 preferably defines ribs 21 for added strength and for guiding material being dumped out of bucket 10. A reinforced mounting plate 24 is disposed on insert 10 and defines holes 23 for receiving bolts/screws 25 or other known attachment devices used for attaching insert 20 within bucket 10.

Figure 2:
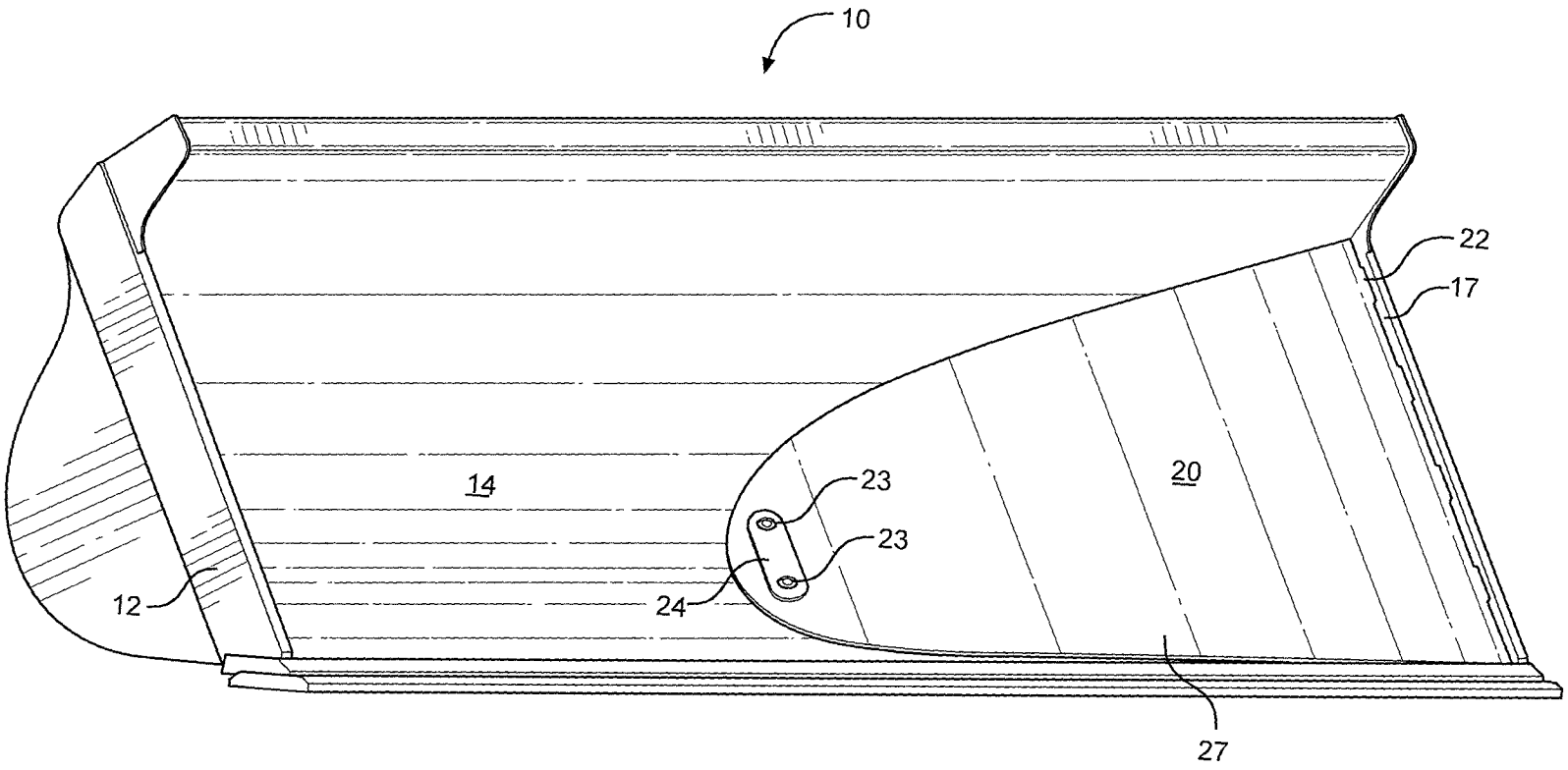
FIG. 2 is a left perspective view of the dump bucket of FIG. 1.
Figure 3:
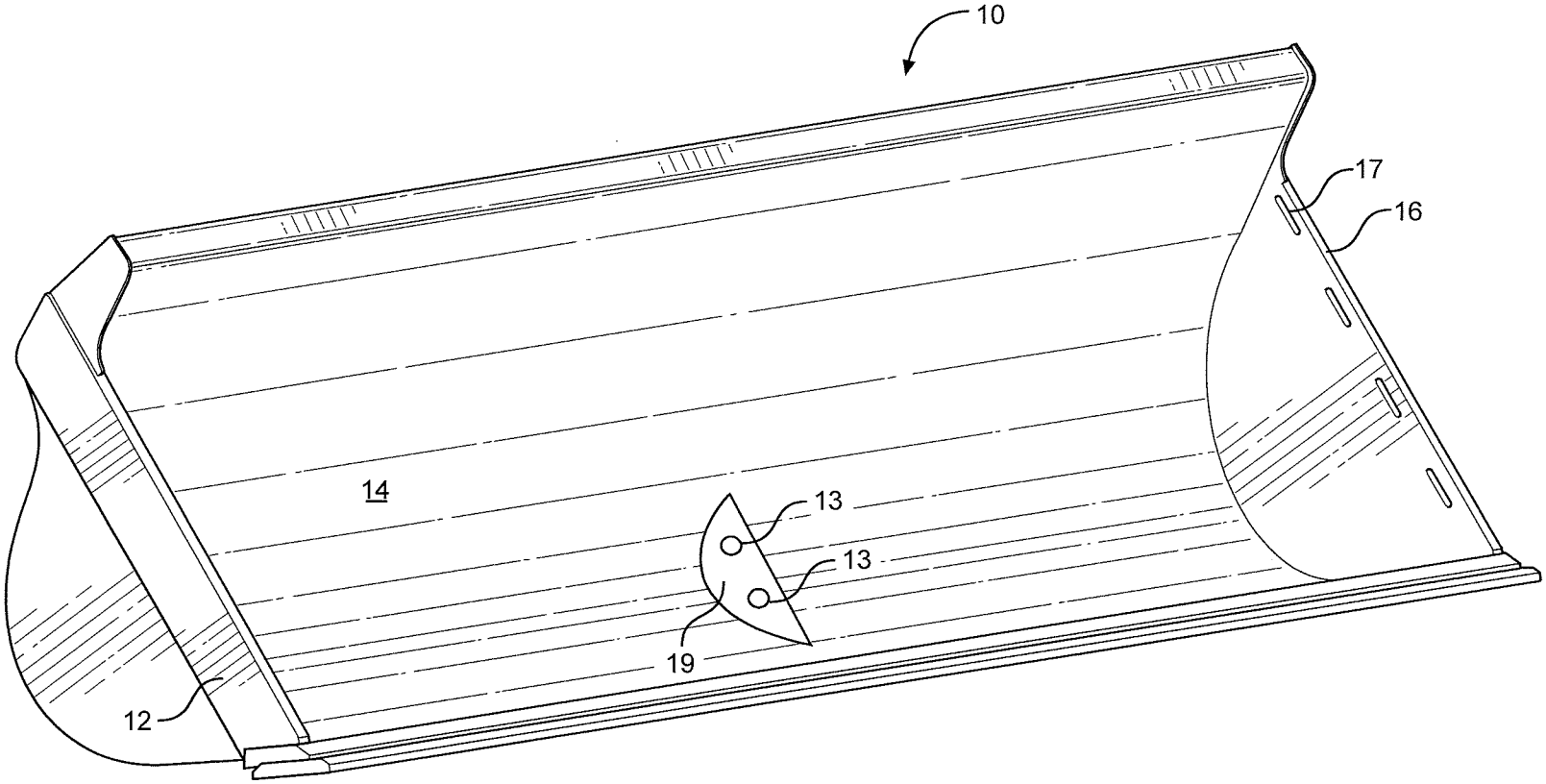
FIG. 3 is a front perspective view of the dump bucket of FIG. 1 with the insert removed.
Figure 4:
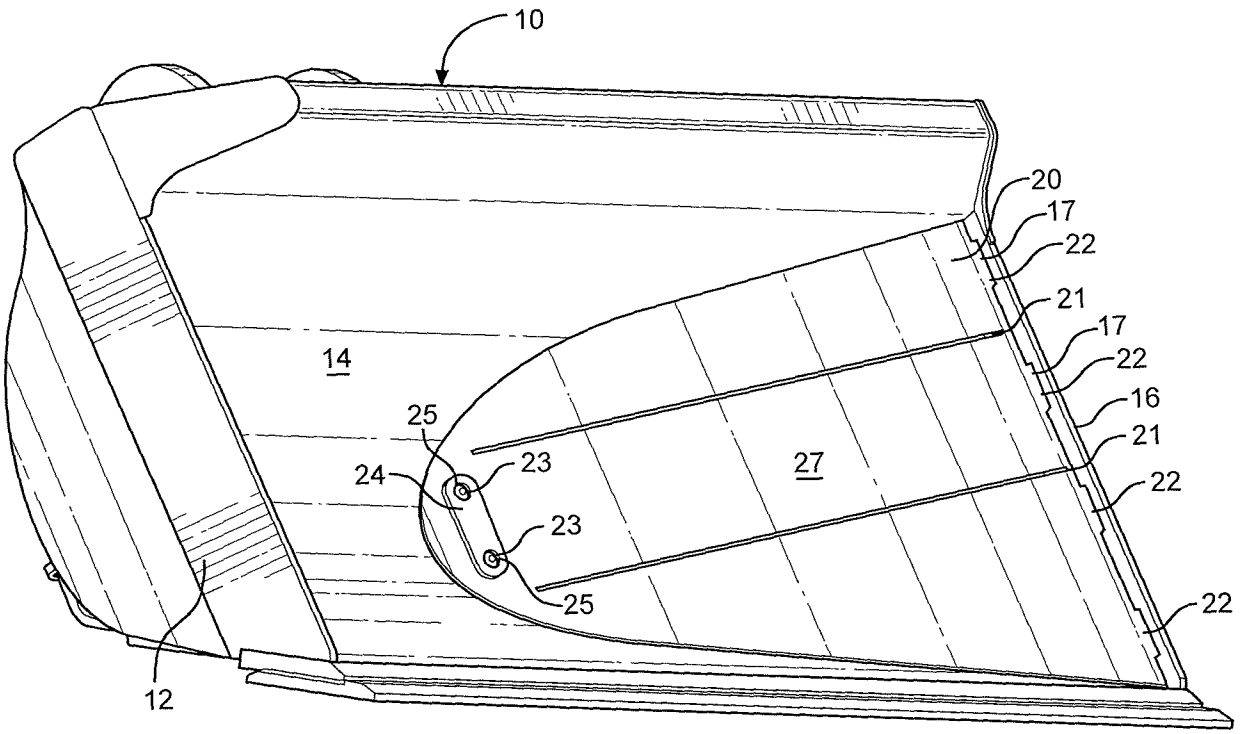
FIG. 4 is another left perspective view of the dump bucket of FIG. 1.
Figure 5:
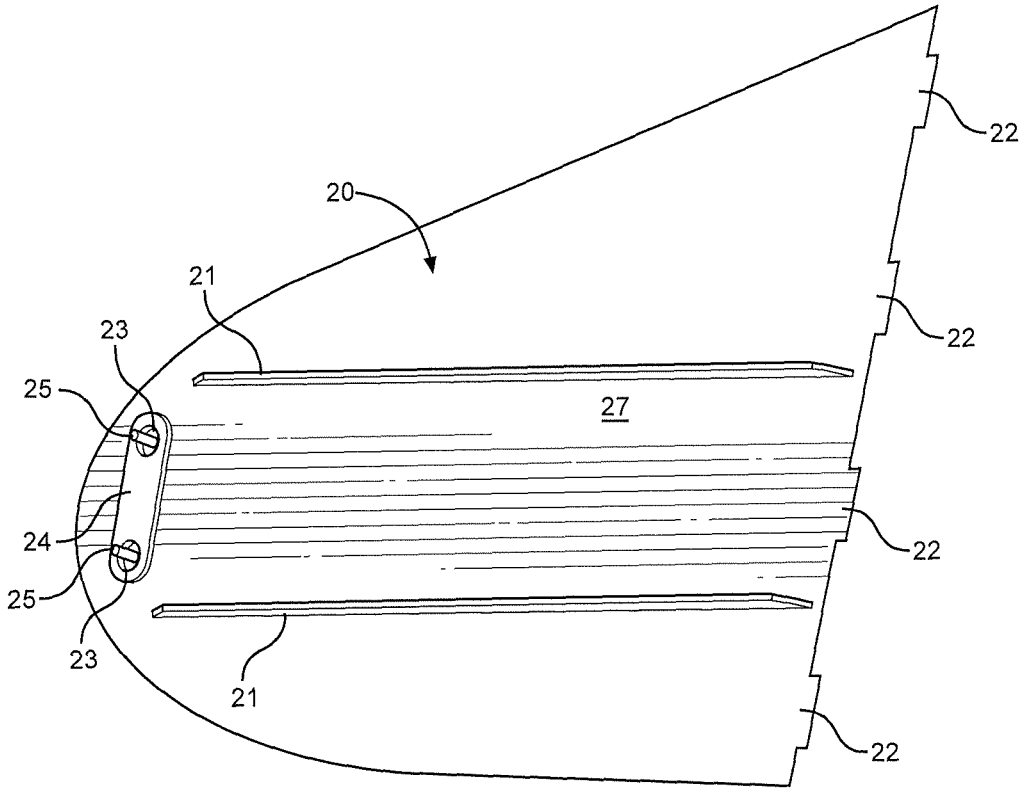
FIG. 5 is a front side view of the removable insert of the dump bucket of FIG. 1.
Figure 6:
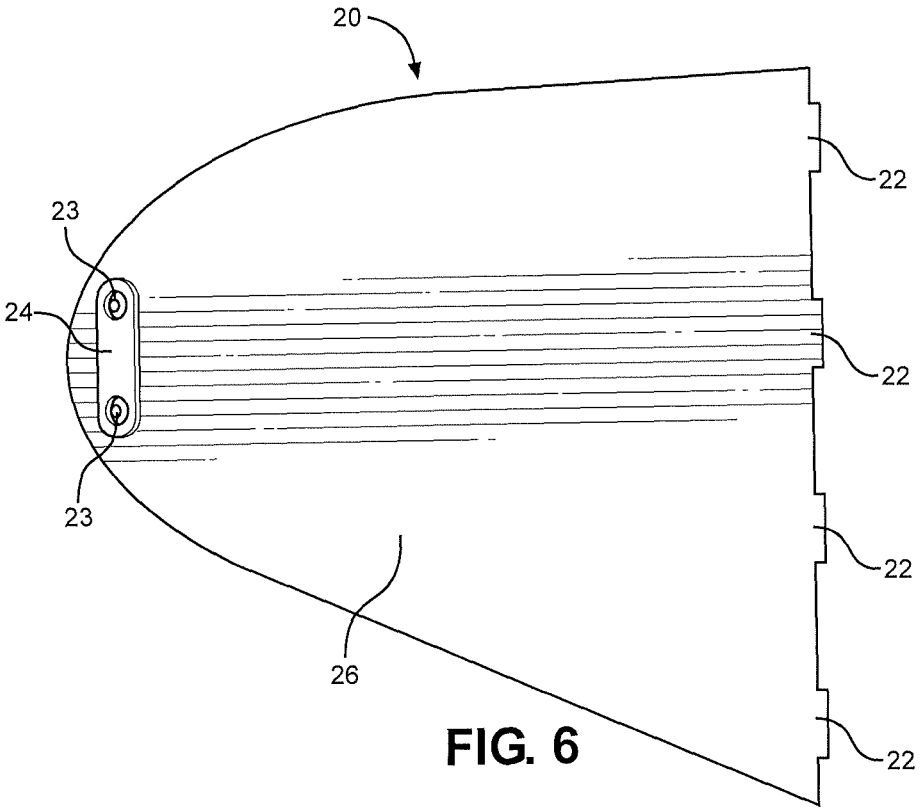
FIG. 6 is a back side view of the removable insert of the dump bucket of FIG. 1.

As best shown in FIGS. 2-4, are the slots 17 in side 16 of bucket 10 that receive tabs 22 of insert 20 to provide a secure installation of insert 20 in bucket 10.

FIG. 7 shows the rear side 11 of bucket 10 on which hydraulic cylinder 30 and hinge 40 are mounted to provide the side dumping functionality as desired. Bucket 10 of the present disclosure may be configured to provide side dumping functionality to either side or both sides of bucket 10, which encompasses having an insert 20 installed in each side within bucket 10 and/or multiple hydraulic cylinders 30 and hinges 40 as may be required for such side dumping functionality.

Figure 9:
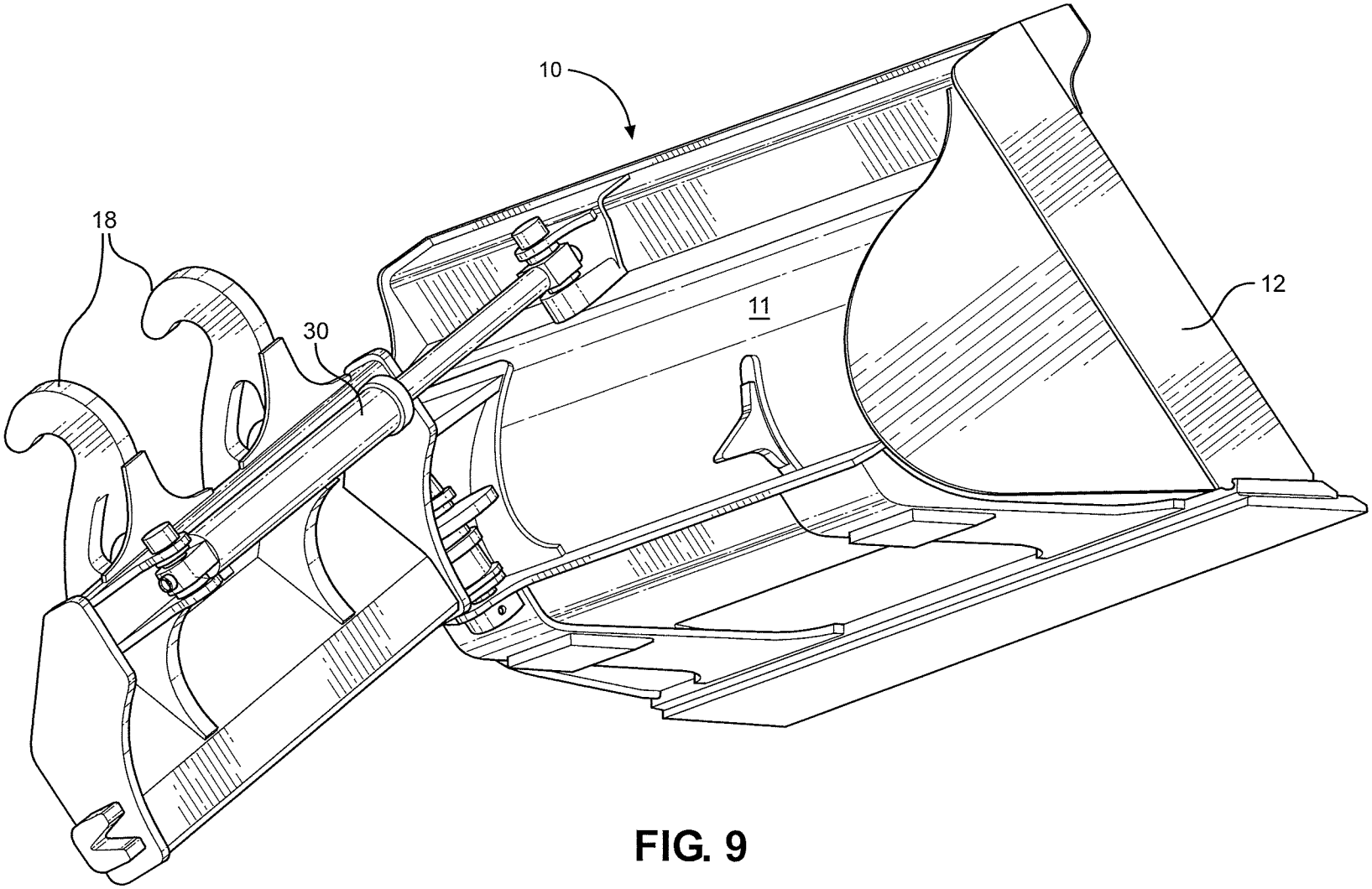
FIG. 9 is a right, rear perspective view of the dump bucket of FIG. 1.

FIGS. 8 and 9 provide front and rear views, respectively, of the bucket 10 in an extended position with hydraulic cylinder 30 extended to provide for side dumping out of side 16 of bucket 10.

Side dumping bucket 10 and insert 20 provide flexibility for using a single bucket in various modes. With insert 20 installed, side dumping of material out of bucket 10 is enhanced. With insert removed, bucket 10 provides greater volume capacity and full enclosures on both sides in contrast to side dumping buckets having permanent side openings.

It will be readily understood to those skilled in the art that various other changes in the details, components, material, and arrangements of the parts and methods which have been described and illustrated in order to explain the nature of this disclosure may be made without departing from the principles and scope of the disclosure as expressed in the subjoined claims.

In the foregoing description of preferred embodiments of the present disclosure, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the foregoing description, with each claim standing on its own as a separate embodiment.

What is claimed is:

1. A dump bucket, comprising:

a first side, a second side defining a plurality of slots, and an inner surface; and an insert having a first curved side and a second straight side; wherein the insert has a top surface defining one or more ribs; wherein the insert has a straight-line cross-section and wherein the insert is installed between the inner surface and the second side of the dump bucket at an angle to aid in side dumping out of the second side of the dump bucket; wherein tabs defined by the second side of the insert are received in the slots in the second side of the bucket; and an insert mount defining first holes disposed on the inner surface and a mounting plate defining second holes disposed on the insert for securely attaching the insert within the bucket utilizing attachment devices disposed through the first and second holes, respectively.

2. A side dumping insert for installation within a dump bucket to facilitate dumping material out of a side of the dump bucket comprising:

a first curved side;

a second straight side defining a plurality of tabs wherein the tabs are received in slots in a side of the bucket;

wherein the insert has a top surface defining one or more ribs; and wherein the insert has a straight-line cross-section.

3. The side dumping insert of claim 2 further comprising a mounting plate defining mounting holes disposed on the insert near the first curved side.

* * * * *